United States Patent [19]

Wang

[11] Patent Number: 4,818,383

[45] Date of Patent: Apr. 4, 1989

[54] APPARATUS AND METHOD FOR INSPECTING AND GRADING SAMPLES OF GRAIN

[76] Inventor: Robert O. Wang, 2744 S. 61st St., Milwaukee, Wis. 53219

[21] Appl. No.: 115,826

[22] Filed: Nov. 2, 1987

[51] Int. Cl.[4] ..... B07C 7/04

[52] U.S. Cl. ..... 209/702; 209/509; 209/6.43; 209/942; 414/405

[58] Field of Search ..... 209/509, 606, 614, 538, 209/643, 702, 703, 938, 942, 933; 206/564, 569; 73/865.8; 414/405, 786

[56] References Cited

U.S. PATENT DOCUMENTS

| | | | |
|---|---|---|---|
| 808,117 | 12/1905 | Shoemaker | 209/938 X |
| 1,397,955 | 11/1921 | Gifford et al. | 209/933 X |
| 1,513,482 | 10/1924 | Brown | 209/643 |
| 2,111,163 | 3/1938 | Yency | 414/405 |
| 2,759,391 | 8/1956 | Lehman | 209/643 |
| 3,794,327 | 2/1974 | Washington | 414/405 X |
| 3,926,305 | 12/1975 | Wallestad | 414/405 X |
| 4,061,228 | 12/1977 | Johnson | 206/564 X |
| 4,462,496 | 7/1984 | Stafford | 209/614 X |

*Primary Examiner*—Johnny D. Cherry
*Assistant Examiner*—Donald T. Hajec
*Attorney, Agent, or Firm*—James E. Nilles; Thomas F. Kirby

[57] ABSTRACT

Apparatus and method for inspecting and grading a grain sample involves the use of a first tray having an upwardly-facing grooved surface on which kernels of grain can be arranged in rows for a first inspection. A second tray is placed on top of the first ray and has a resiliently compressible deformable surface which faces downwardly and bears against kernels in the grooved surface of the first tray so as to entrap and immobilize any kernels of grain on the first tray. Both trays are then overturned so that resilient surface of the second tray faces upwardly and grooved surface of the said tray faces downwardly. When said first tray is removed from association with the second tray, the kernels, now overturned, are arranged on the resilient surface of the second tray and are ready for further inspection.

7 Claims, 2 Drawing Sheets

APPARATUS AND METHOD FOR INSPECTING AND GRADING SAMPLES OF GRAIN

BACKGROUND OF THE INVENTION

1. Field of Use This invention relates generally to apparatus and method for inspecting and gradin samples of grain, beans or similar commodities. In particular, it relates to apparatus comprising two trays and methods for using the trays.

2. Description of the Prior Art

Federal, state and industry regulations require grain and similar commodities to be graded according to the percentage by weight of damaged kernels contained in randomly selected sample of specific weight (for corn, typically approximately 250 grams). Damage to any given kernel can appear on one or more sides of the kernel and, therefore, it is necessary that all sides of each kernel in that sample be visually inspected during grading.

Heretofore, the process of inspecting and grading the grain sample involved the steps of placing the sample in a pile on a table surface, manually spreading out the kernels into a single layer, and visually inspecting the exposed portions of the kernels to determine if any is damaged or suspected of being damaged. The inspector then employed his fingers or tweezers to lift the damaged or suspect kernel and examined it on all surfaces to confirm any actual or suspected damage. An actually damaged kernel was disposed of in a separate pile (or container) for subsequent weighing. A selected but undamaged kernel was disposed of in another pile (or container). Each kernel remaining on the table was then turned over, one at a time, and the previously unexposed portions thereof were visually inspected. Selecting and disposing of certain kernels was then carried in the same manner as above described.

Needless to say, this prior art technique is tedious and time-consuming, even for highly skilled and efficient inspectors, especially since each kernel not disposed of in the first visual inspection needs to be individually turned over to enable the second inspection to proceed.

SUMMARY OF THE INVENTION

The present invention provides improved apparatus and methods for inspecting and grading samples of grain or similar commodities. In particular, the invention provides an efficient way to inspect all sides of all kernels in a given sample.

The apparatus comprises two separate portable trays, each rectangular in shape, one being a grooved tray having a grooved surface and the other being a cushioned tray having a resiliently compressible deformable surface formed, for example, by a layer of foam rubber or plastic. The apparatus further comprises an optionally usable portable collection trough.

In use, the grooved tray is supported and disposed, as on a table, so that its grooved surface faces upwardly. A measured sample of grain is poured onto the grooved surface and distributed, either by sweeping motions of the hand or by shaking the tray, so that the kernels are arranged in rows in the grooves and in a single-layer. The visible sides of the kernels are visually inspected row by row and each kernel which is obviously damaged or suspected of being damaged is picked up, preferably by a vacuum finger, and completely inspected visually on all sides. If damaged, it is set aside in a pile or container for damaged kernels. If found to be undamaged, it is set aside in another pile or container for undamaged kernels.

When all visible surfaces of the kernels in the grooves have been viewed, the cushioned tray is then brought into play to enable the remaining kernels to be turned over simultaneously for further inspection without disrupting their arrangement in orderly rows in a single layer. More specifically, the cushioned tray with its resiliently compressible deformable surface facing downwardly is placed on top of the grooved tray so that the resiliently compressible surface engages the kernels on the grooved surface and entraps and immobilizes those kernels. Then, both trays are manually gripped so as to maintain them in tight face-to-face relationship, lifted from the table, manually rotated together about a horizontal axis so that the lower grooved tray is now on top, and placed back on the table. At this point, the cushioned tray lies beneath the grooved tray. The grooved tray is carefully lifted from the cushioned tray so as not to disturb the kernels, which now lie in single-layered rows on the upwardly facing resiliently compressible undeformed surface of the cushioned tray, and the grooved tray is set aside. The now-visible opposite sides of the kernels are then visibly inspected row by row and any kernels obviously or apparently damaged are picked up, inspected and disposed of in the same manner as previously described. When the inspection is complete, the undamaged kernels remaining on the resiliently compressible deformable surface of the cushioned tray need to be disposed of, as by placing them in a container in which they can be weighed (along with those kernels previously inspected, selected out, found to be undamaged and set aside).

Although it is possible to individually pick up or scoop up the kernels remaining on the resiliently compressible surface, it is preferable and more efficient to employ the portable collection trough, hereinbefore referred to. The collection trough comprises a member defining an elongated trough open on its upper side, closed at one end, open at its opposite end and having supporting means whereby it can be supported on the table with the open upper side of the trough facing upwardly. The elongated trough is longer than the longest side edge of the cushioned tray. In use, the cushioned tray with the kernels remaining thereon is manually lifted from the table, placed so that one edge overlies the trough and tilted so that the kernels thereon fall into the trough. Thereafter, the kernels in the trough can be poured from the open end of the trough as required.

Apparatus for inspecting and grading grain samples in its broadest aspect comprises a first tray having a first surface on which kernels of grain can be arranged for inspection when said surface faces upward; and a second tray removably disposable against said first tray and having a second surface for disposition against said first surface of said first tray; at least one said first and second surfaces being resiliently compressible to entrap and immobilize any kernels of grain on said first tray as both trays are overturned so that said second surface of said second tray faces upwardly and said first surface of said first tray faces downwardly, whereby said kernels are arranged on said second surface of said second tray for further inspection when said first tray is removed from association with said second tray.

The apparatus further includes a disposal trough having an opening on its upper side and having an opning at one end, said opening on the upper side being longer than a side of said second tray.

The method in accordance with the invention in its broadest aspect employs the two trays described above and in a narrower aspect also employs the trough member. Thus, a method of inspecting kernels in a sample of grain comprises the steps of: arranging the kernels in a single layer on a surface of a first member; visually inspecting the kernels and removing any kernels meeting certain specifications; disposing a second member having a resilient flexible deformable surface over the first member so that kernels remaining on the surface of the first member are trapped between and immobilized relative to both surfaces; overturning both members while the kernels are entrapped and immobilized; removing the first member to expose the kernels now lying on the surface of thesecond member; and visually inspecting these kernels on the surface of the second member and removing any kernels meeting certain specifications.

Preferably, the step of arranging the kernels on the surface of the first member involves arranging the kernels in rows. The method includes the further step of tilting the second member to pour the kernels remaining on the surface of the second member into a trough.

Apparatus and method in accordance with the invention offer several important advantages over the prior art. For example the kernels are easily arranged in single layered rows in the grooved tray thereby facilitating speedy and systematic inspection and selection. All remaining kernels are efficiently and simultaneously turned over for further inspection and selection by means of the cushioned tray in conjunction with the grooved tray. Disposition of the finally inspected undamaged kernels is easily and efficiently accomplished by means of the cushioned tray and the trough member. Time consuming and uneconomical steps are eliminated. The trays and trough are simple and dependable to use and simple and economical to fabricate. Other objects and advantages will hereinafter appear.

DRAWINGS

DESCRIPTION OF PREFERRED EMBODIMENT

Figure 1:
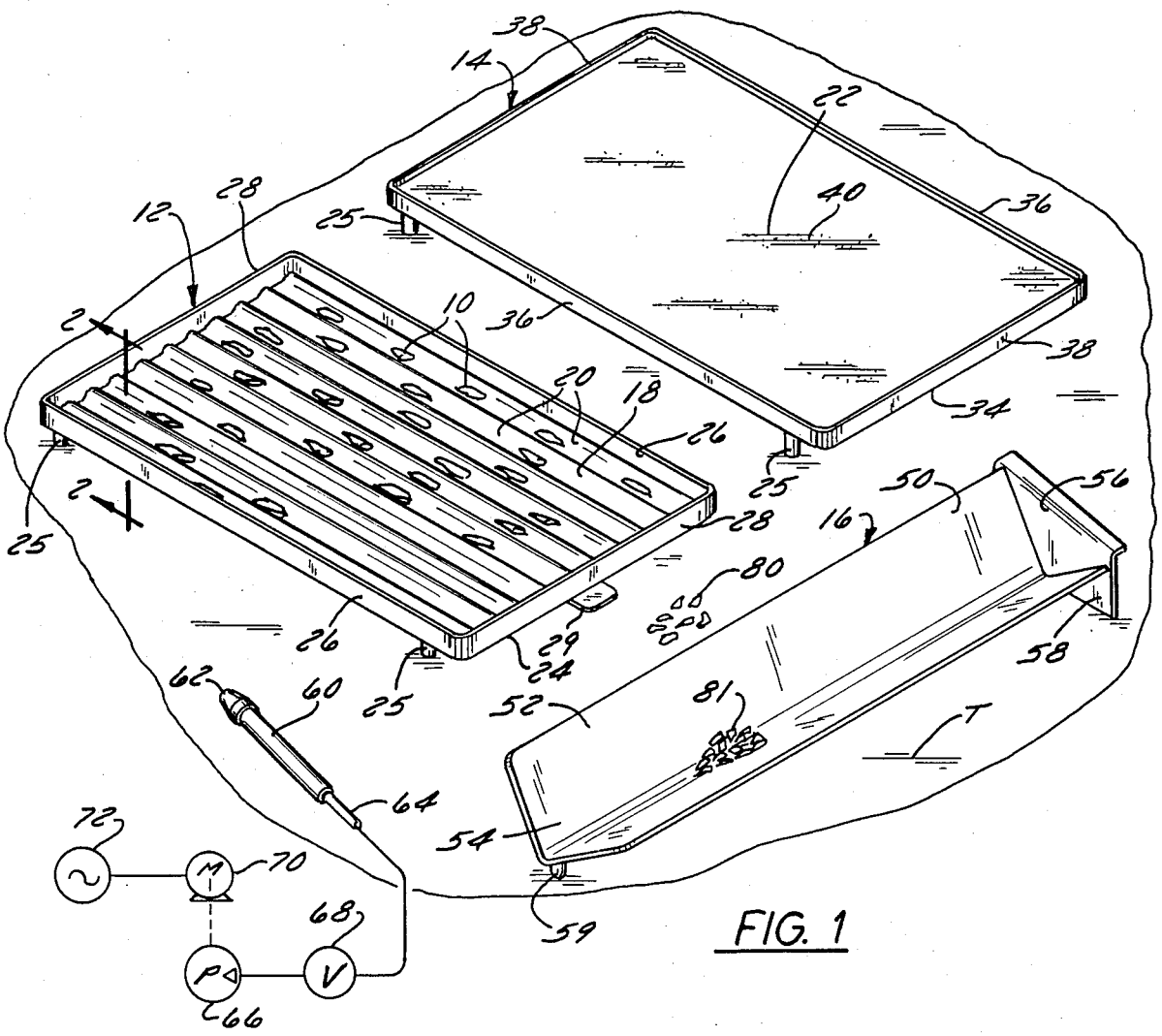
FIG. 1 is an exploded perspective view of apparatus in accordance with the invention and including a grooved tray with grain kernels therein, a cushioned tray and a collection trough.

FIG. 1 shows apparatus in accordance with the invention for inspecting and grading a measured sample of grain comprising a plurality kernels 10, such as dried corn. Such apparatus comprises a first grooved tray 12, a second cushioned tray 14 and an optionally usable collection trough 16, all shown as disposed on a table T.

Referring to FIGS. 1, 2, 3 and 4, grooved tray 12 comprises a grooved surface 18 having a plurality of parallel spaced apart depressions or grooves 20 formed thereon. Cushioned tray 14 comprises a resiliently compressible and deformable planar surface 22.

Tray 12 is fabricated of light-weight aluminum rigid sheet metal formed to provide a rectangular planar base plate 24 having integrally formed bent flanges defining side walls 26 and end walls 28. Tray 12 is provided at opposite ends with lifting handles 29 in the form of metal tabs rigidly connected to the outside of base plate 24. Tray 12 is also provided with four (only two visible) short rubber supporting legs such as 25 so that it rests stably on table T. The grooved surface 18 is defined by a corrugated aluminum member 30 which is located between the side walls 26 and end walls 28 and rigidly secured against base plate 24 by an adhesive (not shown) or by frictional engagement. The width and depth of the side walls of the grooves 20 in surface 18 are sized to accommodate the size of the grain kernels to be inspected and graded. The side walls of the grooves 20 are of lesser height than that of the Kernels in the grooves so that all but one side of the kernels are exposed for visual inspection. Thus, in the embodiment shown each groove 20 has a depth and width to accommodate a corn kernel 10 of average size and so that the uppermost part of a kernel in a groove 20 is near the plane in which lie the protrusions 21 between the grooves 20.

Figure 3:
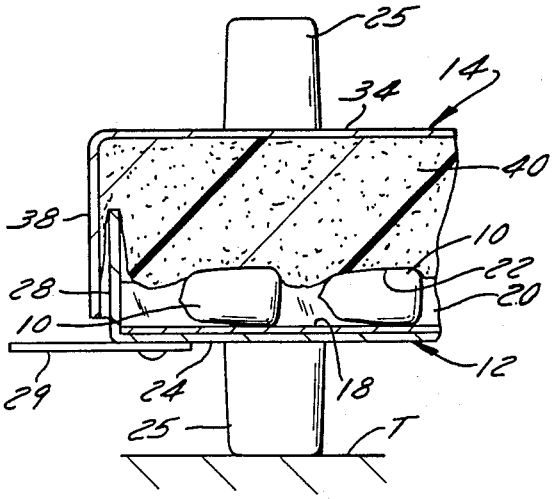
FIG. 3 is an enlarged cross-section view showing portions of the grooved tray with kernels therein facing upwardly and the cushioned tray facing downwardly and associated with the grooved tray.
Figure 2:
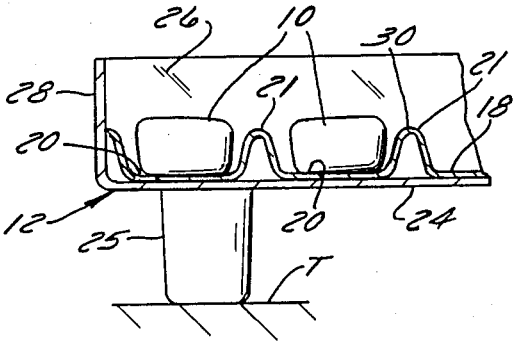
FIG. 2 is an enlarged cross-section view of the grooved tray taken on line 2—2 of FIG. 1.
Figure 4:
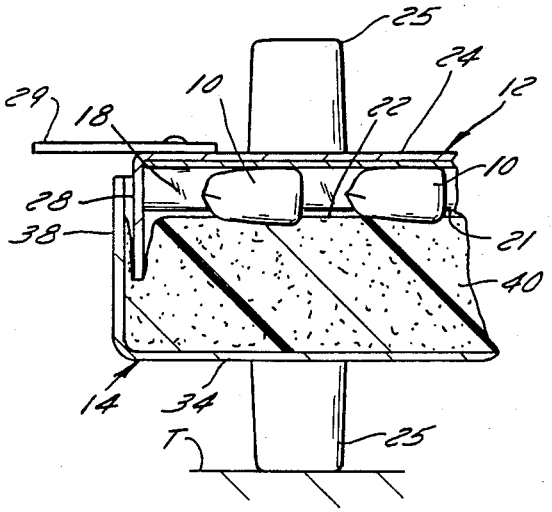
FIG. 4 is a view similar to FIG. 3 but showing the two trays overturned.

Referring to FIGS. 1, 2, 3, 4 and 5, second tray 14 is also fabricated of light weight aluminum rigid sheet metal formed to provide a rectangular planar base plate 34 having integrally formed bent flanges defining side walls 36 and end walls 38. Tray 14 also has legs such as 25. The resiliently compressible and deformable surface planar surface 22 is defined by a foam rubber or foam plastic sheet-like member 40 which is located between the side walls 36 and end walls 38 and rigidly secured against base plate 34 by an adhesive (not shown) or by frictional engagement. The thickness of member 40 is such that, when the two trays 12 and 14 are disposed in face to-face relationship as shown in Figs. 3 and 4, the surface 22 can deform sufficiently to accommodate the outermost portion of the protrusions 21 of member 30 of tray 12 and the outermost portions of the kernels 10 in the grooves 20. This enables the kernels 10 in the grooves 20 to be entrapped and immobilized in the grooves between the surfaces 18 and 22.

Figure 6:
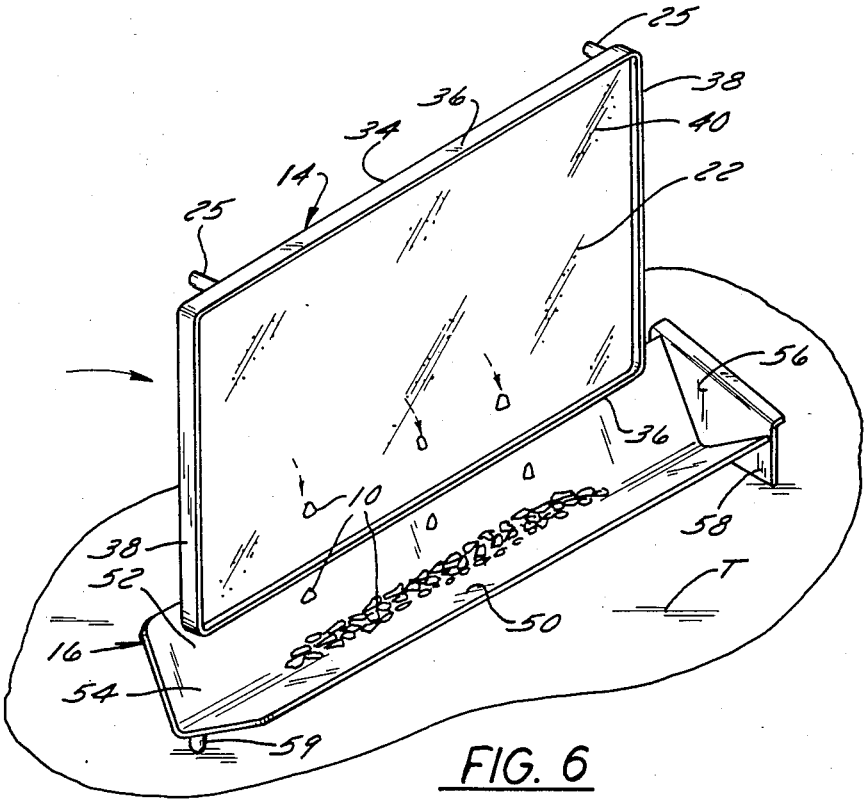
FIG. 6 is a perspective view showing the cushioned tray associated with the collection trough.

Referring to FIGS. 1 and 6, collection trough 16 comprises an elongated trough member 50 which is open at its upper side as at 52, open at one end as at 54, and closed at its other end as by an end plate 56. Trough member 50 has support means, including legs 58 on the bottom of end plate 56 and a leg 59 near its other end, whereby it can be supported on table T with its opening 52 facing upwardly. The elongated opening 52 of trough member 50 is longer than the side walls 36 of cushioned tray 14, as FIG. 6 shows. Trough member 50 may be formed of plastic or metal.

FIG. 1 also shows commercially available equipment which is usable to lift a kernel 10 from the trays 12 and 14 and hold it during inspection thereof. The equipment comprises a hand-held hollow vacuum finger 60 which has an air-hole 62 at its tip and which is connected to one end of a vacuum hose 64 which is connected at its other end to a vacuucm pump 66. Hose 64 is provided with a manually operable on/off valve 68. Vacuum pump 66 is driven by an electric motor 70 which is energizable from an electric power source 72 through a manually operable on/off switch 74. When vacuum pump 66 is in operation, a vacuum is maintained at air-port 62 of vacuum finger 60 and the user can manipulate the vacuum finger to lift up and hold a kernel 10 from a tray 12 or 14 while he visually inspects it. The inspected kernel 10 can be easily dislodged from vacuum finger 60 by the user's fingers or by scraping it against some object.

OPERATION

Referring to FIG. 1, the grooved tray 12 is supported and disposed, as on table T, so that its grooved surface 18 faces upwardly. A measured sample of grain is poured onto grooved surface 18 and the kernels 10 are distributed, either by sweeping motions of the hand or by shaking tray 12, so that the kernels are arranged in the grooves 20 in single-layered rows. The visible sides of the kernels 10 are visually inspected row by row and each kernel which is obviously damaged or suspected of being damaged is picked up, preferably by vacuum finger 60, and completely inspected visually on all sides. If damaged, the kernel 10 is set aside in a pile 80 on table T or in a container (not shown) for damaged kernels. If found to be undamaged, the kernel 10 is set aside in another pile 81 or in collection trough 16 for undamaged kernels. When the visible surfaces of all kernels 10 in the grooves 20 have been viewed, the cushioned tray 14 is then brought into play to enable the remaining kernels on tray 12 to be turned over simultaneously for further inspection without disrupting their arrangement in orderly rows.

Figure 5:
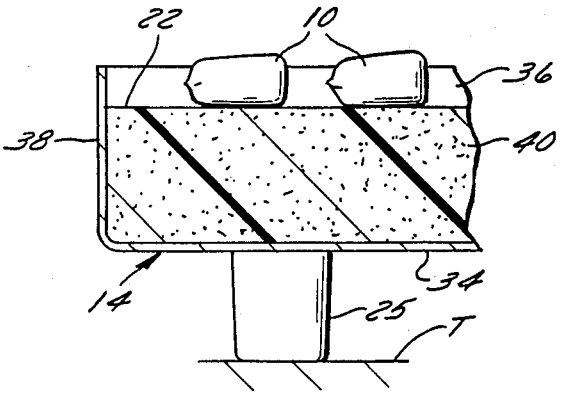
FIG. 5 is a view similar to FIG. 4 but showing the grooved tray removed.

More specifically, as FIG. 3 shows, tray 14 with its resiliently compressible surface 22 facing downwardly is placed over and on grooved tray 12 so that the resiliently compressible surface 22 of tray 14 engages the grooved surface 18 of tray 12 and the kernels 10 thereon and entraps and immobilizes the kernels 10 between the surfaces 18 and 22. Then, both trays 12 and 14 are manually gripped so as to maintain them in tight face-to-face relationship, as shown in FIG. 3, lifted from the table manually, rotated together about a horizontal axis until tray 12 becomes the upper tray and tray 14 the lower tray, and placed back on table T as shown in FIG. 4. At this point, cushioned tray 14 with the resiliently compressible deformable surface 22 facing upward lies beneath grooved tray 12 whose grooved surface 22 faces downwardly. Tray 12 is then carefully lifted from tray 14 so as not to disturb the kernels 10 which now lie in single-layered rows on the now upwardly facing resiliently compressible undeformed surface 22 of tray 14 and tray 12 is put aside, as FIG. 5 shows. The now-visible opposite sides of the kernels 10 are then visibly inspected row by row and any kernels obviously or apparently damaged are picked up, inspected and disposed of in the same manner as previously described.

When the inspection is complete, the undamaged kernels 10 remain on the resiliently compressible undeformed surface 22 of tray 14 need to be disposed of, as by placing them in a container (not shown) in which they can be weighed, along with those kernels previously inspected, selected out, found to be undamaged and set aside. Although it is possible to individually pick up or scoop up the kernels 10 remaining on the resiliently compressible undeformed surface 22 of tray 14, it is preferable that the portable collection trough 16 be employed. Referring to FIG. 6, tray 14 with the kernels 10 remaining thereon is manually lifted from table T, placed so that one edge 36 overlies trough 50 and tilted so that the kernels thereon fall into the trough. Thereafter, the kernels 10 in trough 50 can be poured from the open end 54 of the trough as required.

While tray 12 is disclosed as having depressions in the form of grooves 20, it could be provided with other means, such as reticules or holes (not shown) adapted to receive kernels 10 and dispose them in an orderly predetermined arrangement.

Furthermore, tray 12 could be provided with a resilient compressible member such as 40, in which case the grooves 20 (or their equivalent) would be provided therein. In which case, tray 14 could still retain the member 40 or, it could be omitted from tray 14, provided proper dimensions are used to ensure kernel entrapment.

I claim:

1. Apparatus for inspecting and grading samples of grain, each sample comprising a plurality of kernels of grain and each kernel having a plurality of sides which are visually inspected during grading, said apparatus comprising:

first and second trays having first and second tray surfaces, respectively, each tray having side edges and being rotatably movable when in use between one position and another position wherein the tray surface of one of said first and second trays faces upwardly and the tray surface of the other of said first and second trays faces downwardly;

each tray surface when facing upwardly providing the sole support for kernels disposed thereon;

at least one of said tray surfaces being formed of resiliently compressible material;

and means on said first tray surface and rigidly secured to said first tray having side walls defining a plurality of depressions in which kernels are received when said first tray surface faces upwardly and which effect a predetermined arrangement of kernels on said first tray surface;

said side walls being of lesser height than that of the kernels in said depression so that all but one side of the kernels are exposed for visual inspection;

said second tray being detachably mountable on said first tray with both tray surfaces confronting and spaced sufficiently close to each other to effect compression of said material so that kernels in said depressions are entrapped and immobilized between said tray surfaces, thereby enabling both trays to be rotated simultaneously from one position wherein said first tray surface faces upwardly and said second tray surface faces downwardly to another position wherein said first tray surface faces downwardly and said second tray surface faces upwardly, said first tray being detachable from said second tray when the latter is in its said other position to afford access for visual inspection of sides of said kernels, including said one side, which kernels are arranged on and supported by said second tray surface.

2. Apparatus according to claim 1 further including a disposal trough for receiving kernels from said second tray after said further inspection and having an opening on its upper side for disposition beneath a side edge of said second tray to receive kernels and having an opening at one end from which kernels are poured, said opening on said upper side of said trough being longer than an associated side edge of said second tray.

3. Apparatus according to claim 1 wherein said depressions are grooves.

4. A method of inspecting kernels in a sample of grain comprising the steps of:

arranging the kernels in a single layer on a surface of a first member;

visually inspecting the kernels and removing any kernels meeting certain specifications;

disposing a second member having a resilient flexible deformable surface over the first member so that kernels remaining on the surface of the first member are trapped between and immobilized relative to both surfaces;

overturning both members while the kernels are entrapped and immobilized;

removing the first member to expose the kernels now lying on the surface of the second member;

and visually inspecting the kernels on the surface of the second member and removing any kernels meeting certain specifications.

5. A method according to claim 4 wherein the step of arranging the kernels on the surface of the first member involves arranging the kernels in rows.

6. A method according to claim 4 including the further step of tilting the second member to remove the kernels remaining on the surface of the second member.

7. A method for inspecting and grading a sample of grain comprising the steps of:

providing a first tray having a grooved surface with a plurality of grooves therein and disposing it so that said grooved surface faces upwardly;

disposing a measured sample of grain in said tray so that kernels of grain are arranged in said grooves in a single layer and in rows;

visually inspecting the kernels and removing and setting aside those kernels which are damaged or suspected of being damaged;

providing a second tray having a resiliently compressible surface and disposing it so that said resiliently compressible surface faces downwardly and against the upwardly facing surface of said first tray so as to entrap and immobilize the kernels remaining in said grooves between said grooves and said resiliently compressible surface;

rotating said trays while the kernels are entrapped therebetween so that said second tray is on the bottom and said first tray is on top;

removing said first tray so as to expose the kernels therebeneath which are now arranged in rows on the upwardly facing resiliently compressible surface of said second tray;

and visually inspecting the kernels on said second tray and removing and setting aide those kernels which are damaged or suspected of being damaged.

* * * * *